United States Patent [19]

Sedlmair

[11] Patent Number: 4,484,763

[45] Date of Patent: Nov. 27, 1984

[54] HEELHOLDER FOR A SAFETY SKI BINDING

[75] Inventor: Gerhard Sedlmair, Farchant, Fed. Rep. of Germany

[73] Assignee: Marker-Patentvertwertungsgesellschaft mbH., Baar, Switzerland

[21] Appl. No.: 347,192

[22] Filed: Feb. 9, 1982

[30] Foreign Application Priority Data

Feb. 26, 1981 [DE] Fed. Rep. of Germany ..... 3107230

[51] Int. Cl.[3] ..... A63C 9/085

[52] U.S. Cl. ..... 280/618; 280/620

[58] Field of Search ..... 280/614, 615, 618, 620, 280/626, 627, 631, 632, 617

[56] References Cited

U.S. PATENT DOCUMENTS

| | | | |
|---|---|---|---|
| 3,173,701 | 3/1965 | Beyl | 280/620 |
| 3,963,253 | 6/1976 | Rieger | 280/617 |
| 4,052,086 | 10/1977 | Eckart | 280/618 |
| 4,134,603 | 1/1979 | Zoor | 280/614 |
| 4,190,264 | 2/1980 | Himmetsberger | 280/618 |
| 4,294,461 | 10/1981 | Eckart | 280/618 |

FOREIGN PATENT DOCUMENTS

| | | | |
|---|---|---|---|
| 2504281 | 5/1976 | Fed. Rep. of Germany | 280/620 |
| 1359283 | 3/1964 | France | 280/620 |

*Primary Examiner*—David M. Mitchell

*Attorney, Agent, or Firm*—Woodling, Krost, Rust & Hochberg

[57] ABSTRACT

A heelholder for a safety ski binding comprising a base member, a carriage mounted on the base member for movement in a direction transverse to the longitudinal direction of the ski on which the binding mounted, a retaining spring biasing the carriage to a central, normal position, a pair of cheeks pivotally mounted on the carriage and carrying a heel-releasing mechanism, and a locking mechanism for releasing the cheeks to open the binding when the carriage moves beyond a predetermined distance in the transverse direction.

4 Claims, 2 Drawing Figures

HEELHOLDER FOR A SAFETY SKI BINDING

Figure 1:
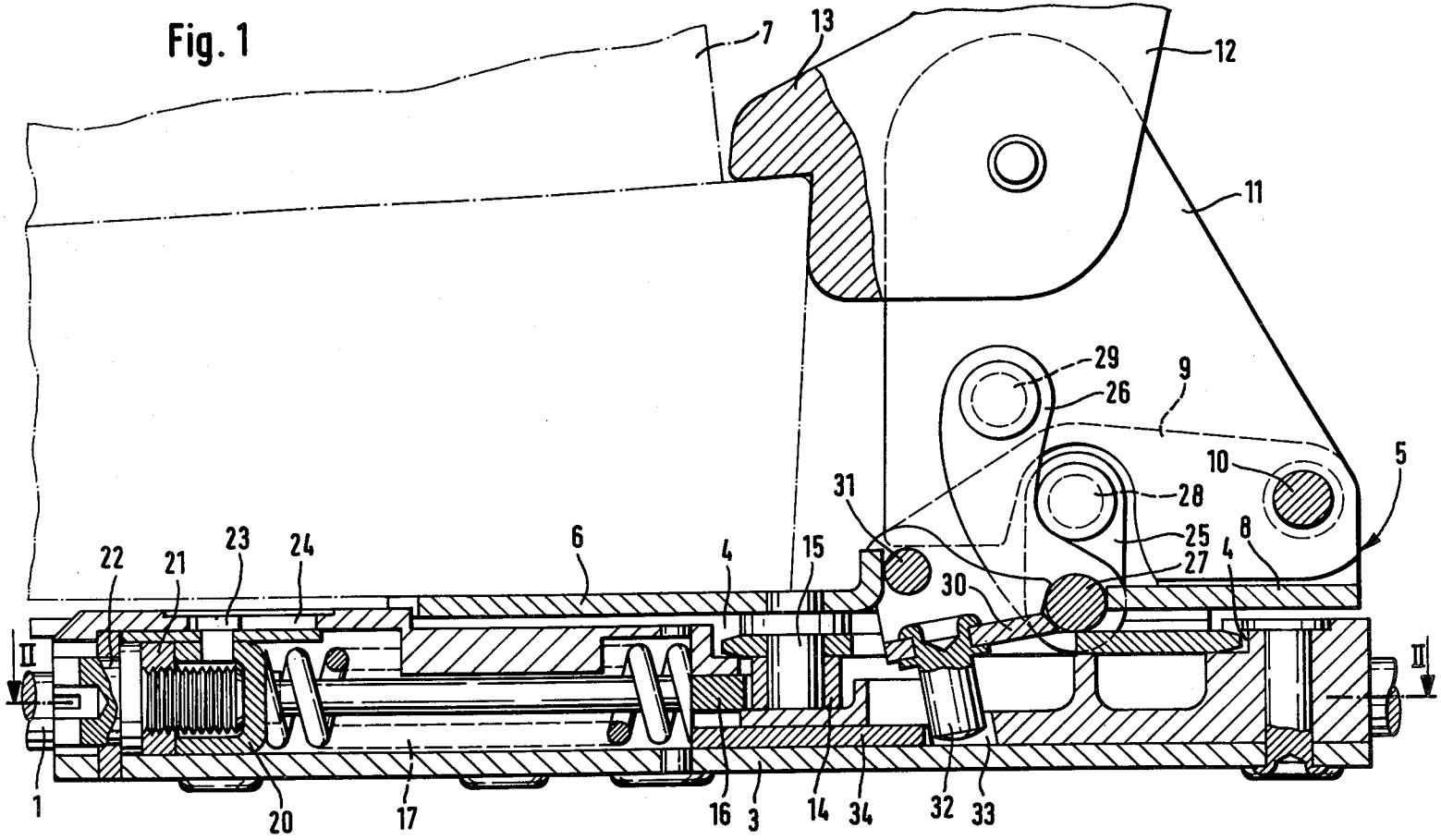

This invention relates to a heelholder for a safety ski binding, comprising a base member, which is adapted to be indirectly or directly connected to the ski, a carriage, which is mounted on said base and comprises a plate and is movable at least approximately transversely to the longitudinal direction of the ski against the force of at least one retaining spring, and a soleholder carried by said carriage.

In such heelholders, which are known, e.g., from U.S. Pat. No. 4,134,603 (which corresponds to Opened German Application 26 58 992), the carriage is mounted on the base member in such a manner that in response to an excessive load applied to the carriage in a direction which is transverse to the longitudinal direction of the ski the carriage can entirely separate from the base member and from the ski so that the skiing boot is released from the binding. The carriage comprises a horizontal plate for supporting the skiing boot. The soleholder is a portion of a heel grip, which is pivoted in bearing eyes of the supporting plate and releases the skiing boot in response to an excessively high load in an upward direction.

Compared to other known heelholders, that heelholder has the advantage that it performs all safety functions of the ski binding and that it is compact so that it can be used also in bindings for cross-country skis.

On the other hand, that heelholder has the disadvantage that in response to twisting falls, which most frequently occur in practice, the carriage will be entirely separated from the base member so that a separate retaining rope or the like must be connected to the carriage and it is necessary after each such release to reconnect the carriage to the base member by complicated and time-consuming manipulations at a time when the skier may be on a difficult, steep slope.

It is an object of the invention to provide an improved heelholder which is of the kind described and retains the inherent advantages of said known heelholder whereas the disadvantage which has been described is avoided in a simple manner and without need for a considerably higher expenditure.

In a heelholder of the kind described first hereinbefore this object is accomplished in that the carriage is movable from a normal position to both sides to a limited extent and is always biased by the retaining spring, the soleholder constitutes a part of a known automatic heel-releasing mechanism, which is adapted to be arbitrarily opened in a vertical direction and to open automatically in response to an overload, the heel-releasing mechanism is held between two vertical longitudinal cheeks, which are pivoted to the carriage on a horizontal axis which is transverse to the ski, and locking means are provided, which hold the longitudinal cheeks in an operative position and are arranged to release the longitudinal cheeks in response to a predetermined lateral movement of the carriage.

Just as in the known heelholder, an excessive upward vertical load applied to the heelholder according to the invention will cause the automatic heel-releasing mechanism to release the skiing boot. On the other hand, an excessive load in a direction which is transverse to the longitudinal direction of the ski will result only in a lateral movement of the carriage until the longitudinal cheeks are released by the associated locking means so that the automatic heel-releasing mechanism can then perform an upward pivotal movement together with the longitudinal cheeks and the skiing boot will thus be released by the soleholder. As the carriage is constantly biased by the retaining spring, the carriage will automatically return to its normal position after the lateral movement.

Further features of the invention will become apparent from the dependent claims.

The heelholder according to the invention is particularly suitable also for use in bindings for cross-country skis. As the heelholder can perform all safety functions required in a ski binding, the toe unit of the binding may be very simple and may consist e.g., of a bent wire.

Figure 2:
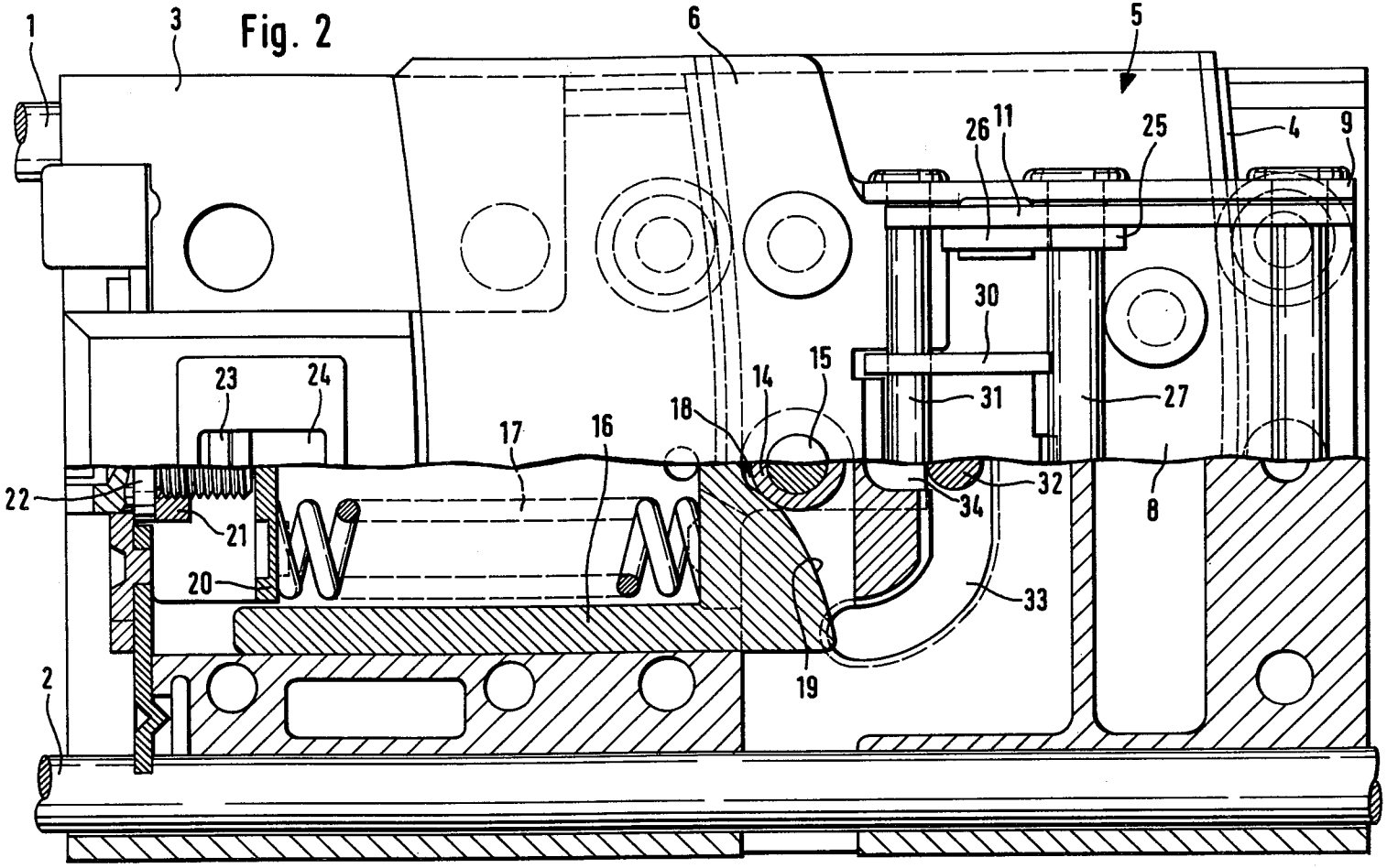

An embodiment of the heelholder according to the invention will be described hereinafter more in detail and by way of example with reference to the accompanying drawings, in which FIG. 1 is a vertical longitudinal sectional view showing the heelholder and FIG. 2 is in its upper half a top plan view showing the heelholder without the automatic heel-releasing mechanism and in its lower half a sectional view taken on line II—II in FIG. 1.

The present heelholder shown on the drawings is indirectly rather than directly connected to the ski. This is effected by a cross-country binding frame, which is known per se and for this reason is not shown in detail. A carrying frame comprises two rods 1 and 2, which extend in the longitudinal direction of the ski and on which the heelholder is longitudinally slidably mounted to permit an adaptation to different boot sizes. The base member 3 of the heelholder consists of a housing, which is provided at its top with a track 4, which extends transversely to the longitudinal direction of the ski and in which a carriage 5 is slidably mounted and held against being lifted upwardly from the housing. The means for mounting the carriage may be designed in any suitable manner and the details thereof do not constitute a part of the present invention.

The carriage is provided with a lug 6, which constitutes a pedal for actuation by a skiing boot 7, which is indicated in phantom in FIG. 1. The pedal is connected on the right, when viewed as in the drawings, to a plate-like member 8 of the carriage. That plate 8 is provided on both longitudinal sides with upwardly angled leg portions 9, which are arranged in mirror symmetry so that the plate 8 is channel-shaped. The two legs 9 carry a transverse horizontal pivot pin 10, on which two longitudinal cheeks 11 are pivoted, which are arranged in mirror symmetry. An automatic heel-releasing mechanism 12 is mounted between said longitudinal cheeks. That automatic heel-releasing mechanism too is no part of the present invention and may be of the kind which is known, e.g., from U.S. Pat. No. 3,173,701 (which corresponds to German Patent Publication 1,205,875). That automatic heel-releasing mechanism can be opened arbitrarily and can automatically open under an overload.

The automatic heel-releasing mechanism 12 comprises a soleholder 13, which engages from above the rear end portion of the sole of the skiing boot 7.

The carriage 5 can be laterally moved to a limited extent from a central, normal position. The carriage 5 carries a detent roller 14, which is mounted on a vertically depending pin 15. By means of that detent roller 15, the carriage is operatively connected to a transmission means in the form of a piston 16, which is displaceable in the housing 3 in the longitudinal direction against the force of two compression springs 17, which are indicated by dotted lines. The detent roller 14 is normally received by a central detent aperture 18 formed in the piston 16 so that the latter tends to hold the carriage 5 in its normal position. The detent aperture 18 is adjoined on both sides by run-up surfaces 19 for cooperating with the detent roller 14. The two compression springs 17 bear on a yoke 20 at points which are symmetric with respect to the longitudinal axis of the base member 3. The yoke engages a nut 21, which is screwed on an adjusting screw 22 and non-rotatably held in the base member. That adjusting screw is rotatably mounted in the base member and can be rotated to change the initial stress of the compression springs 17. The yoke 20 carries in known manner a pointer 23, which is visible through a window 24 provided in the top of the base member 3.

The longitudinal cheeks 11 are normally held in their normal position, shown in FIG. 1, against a pivotal movement about the transverse pivot pin 10. This is ensured by locking means comprising a toggle joint having toggle arms 25 and 26 and a hinge 27. Each of the two arms consists of two congruent members, which are coaxially disposed on both sides of the vertical longitudinal plane and symmetrical thereto. Only one of said members is shown in each of the figures of the drawings, and for the sake of simplicity the arms will be referred to only in the singular hereinafter.

The toggle arm 25 is pivoted by a pin 28 to the leg 9. The toggle arm 26 is pivoted by a pin 29 to the longitudinal cheek 11. The hinge comprises a pin, which extends between the two legs 9 and between the two congruent members of each toggle arm. A locking lever 30 is provided to hold the toggle joint in its locking position, shown in the drawings. The locking lever 30 is pivoted to the carriage 5 on another pivot pin 31, which is parallel to the pivot pins of the toggle joint. The locking lever 30 carries a cam follower pin 32, which at its free end extends into a cam groove 33, which is formed in the lower inside surface of the housing 3. The shape of the cam groove is apparent from the lower half of FIG. 2. The cam groove 33 comprises two portions which are disposed in mirror symmetry on opposite sides. The intermediate portion of the cam groove is enlarged to the left in the drawings and is bridged by a flat slider 34, which at that end which is on the left in the drawings is biased by the compression springs 17 so that the locking lever 30 is spring-loaded in its normal position.

FIG. 1 shows the heelholder in position for use, with the skiing boot 7 inserted. It is assumed that the cross-country ski binding frame extending under and behind the heelholder is locked to the ski so that the safety ski binding is arranged for a downhill run. When the heelholder 13 of the automatic heel-releasing mechanism 13 is subjected to an upwardly directed force which exceeds the opposing force exerted by the heel-releasing mechanism, the skiing boot will be released by a conventional safety opening movement of the automatic heel-releasing mechanism.

The heelholder can be arbitrarily opened in the same manner if the force is applied to the longer part of the automatic heel-releasing mechanism rather than to the soleholder. That longer portion is not shown.

During a torsional load, force is transmitted from the boot 7 to the soleholder 13 into the plane of the drawing or in the opposite direction while the boot 7 is turning on a fulcrum at the forward end of the sole. For this purpose the forward end of the sole is suitably mounted and held on the cross-country ski binding frame by known means, not shown. If that lateral load does not exceed the initial of the compression springs 17, the carriage 5 will not move relative to the base member 3. In response to a higher load, the carriage by means of its detent roller 14 forces the piston 16 back against the force of the compression spring 17, to the left when viewed as in the drawings. As a result, the detent roller 14 leaves the detent aperture 18 and runs up on the respectve run-up surface 19. During the transverse movement of the carriage, the cam follower pin 32 of the locking lever 30 performs a lateral movement in the cam groove 33.

As the force decreases, the compression springs 17 move the carriage back to its initial position. If the lateral force is so strong that the carriage is moved laterally to such an extent that the cam follower pin 32 enters the curved portion of the cam groove, then the locking lever 30 will be turned on its pivot 31 in the clockwise sense in FIG. 1 so that the toggle joint 27 will be unlocked. When the toggle joint has been unlocked, a component of force is effective by which the automatic heel-releasing mechanism 12 is turned with the longitudinal cheeks 11 about the transverse pivot 10 also in the clockwise sense in the drawing so that the boot 7 is released and can separate from the ski.

When the action of force has ceased, the carriage 5 is automatically returned to its normal position and the locking lever 30 is also returned to its locking position. The heelholder can then be returned to its operative position in that the longitudinal cheeks 11 together with the automatic heel-releasing mechanism 12 are turned in the counterclockwise sense so that the toggle joint 27 strikes on the locking lever 30, and displaces the slider 34 to turn the locking lever 30 to the left in the drawings until the toggle joint has moved past the locking lever 30, which then springs back to lock the toggle joint, the longitudinal cheeks 11 and the automatic heel-releasing mechanism in position.

What is claimed is:

1. A heelholder for a safety ski binding, said heelholder comprising:

a base member attachable to a ski extending in the longitudinal direction of the ski;

a carriage mounted in said base member for movement in a transverse direction along a curved path relative to said longitudinal direction;

retaining spring means biasing said carriage to a normal position along said longitudinal direction and out of said transverse direction;

a pair of cheeks pivotally mounted on said carriage for rotation about an axis transverse to said longitudinal direction between a closed position and a releasing position;

a heel-releasing mechanism attached to said cheeks, said heel-releasing mechanism assuming a heel engaging position when said cheeks are in the closed position and said heel-releasing mechanism being out of the heel engaging position when said cheeks are in the releasing position; and locking means for releasably locking said cheeks in the closed position, said locking means releasing said cheeks for movement to the releasing position in response to movement of said carriage beyond a predetermined distance in said transverse direction;

wherein said locking means comprises a toggle joint having axes parallel to the axis of rotation of said cheeks and a locking lever pivotally mounted on said carriage for rotation about an axis parallel to the axes of said toggle joint and biased into a locking position for releasably locking said toggle joint, said locking lever having a pin connected thereto, and said base member formed with a cam groove for cooperating with said pin to release said locking lever from the locking position to unlock said toggle joint when said carriage moves beyond said predetermined distance in the transverse direction.

2. The invention according to claim 1 and further comprising a roller mounted on said carriage for rotation about a vertical axis, and transmission means biassed by said retaining spring means against said roller, said roller moving said transmission means in response to movement of said carriage in said transverse direction, and said pin of said locking lever moving in said cam groove in response to the movement of said roller.

3. The invention according to claim 2 wherein said transmission means comprises a piston having a detent depression for receiving said roller when the carriage is in the normal position.

4. The invention according to claim 1 wherein said base member includes a track extending in the transverse direction, said carriage being mounted for movement on said track.

* * * * *